US005690532A

United States Patent [19]

Sims

[11] Patent Number: 5,690,532

[45] Date of Patent: Nov. 25, 1997

[54] METHOD FOR FORMING TUNGSTEN ELECTRODE

[75] Inventor: John W. Sims, Weedsport, N.Y.

[73] Assignee: Welch Allyn, Inc., Skaneateles Falls, N.Y.

[21] Appl. No.: 667,987

[22] Filed: Jun. 19, 1996

Related U.S. Application Data

[62] Division of Ser. No. 268,255, Jun. 29, 1994, Pat. No. 5,539,273.

[51] Int. Cl.[6] ..... H01J 9/14

[52] U.S. Cl. ..... 445/49; 205/666

[58] Field of Search ..... 205/666, 640, 205/674; 216/13; 445/49; 313/335, 574, 631, 632; 65/59.1

[56] References Cited

U.S. PATENT DOCUMENTS

| | | | |
|---|---|---|---|
| 3,259,778 | 7/1966 | Fridrich | 313/632 |
| 3,340,718 | 9/1967 | Heisler | 313/631 |
| 3,497,425 | 2/1970 | Cotton | 216/13 |
| 4,038,579 | 7/1977 | Ekkelboom | 313/335 |
| 4,452,677 | 6/1984 | Richardson | 205/674 |
| 5,083,059 | 1/1992 | Graham et al. | 313/631 |
| 5,117,154 | 5/1992 | Thomas et al. | 313/631 |
| 5,144,201 | 9/1992 | Graham et al. | 313/623 |
| 5,527,199 | 6/1996 | Feder et al. | 445/49 |

*Primary Examiner*—Michael Horabik
*Assistant Examiner*—Michael Day

[57] ABSTRACT

A one piece electrode is disclosed for use in miniature and subminiature lamps having a large diameter post section and a smaller diameter lead-in section. The lead-in section is formed by an electrochemical process from a wire that has an outer diameter equal to the desired post diameter. A smooth evenly tapered transition section between the post and lead-in sections is created during the etching process which permits heat to pass through the electrode at a controlled and predictable rate.

1 Claim, 2 Drawing Sheets

METHOD FOR FORMING TUNGSTEN ELECTRODE

This is a divisional of application Ser. No. 08/268,255 filed on Jun. 29, 1994, now U.S. Pat. No. 5,539,273.

BACKGROUND OF THE INVENTION

This invention relates generally to metal halide arc lamps and in particular, to an electrode for use in miniature and subminiature arc lamps that operate at or below 40 watts.

A low wattage metal halide arc lamp having extremely high efficacy is disclosed in U.S. Pat. No. 5,144,201. The lamp described in this patent has a geometry that is specifically designed to minimize heat loss from the arc chamber thus maintaining the fill gases at a high operating temperature needed to produce high output illumination. A further U.S. Pat. No. 5,083,059 teaches of the desirability of shaping the electrodes used in a miniature or subminiature lamp to further control the loss of heat from the arc chamber.

The arc lamp described in the '201 patent generally includes a glass or quartz envelope having a hollow arc chamber and a pair of opposed outwardly disposed shanks. As taught in the '059 patent, the electrodes each have a relatively large diameter post section and a smaller diameter lead-in section. In assembly, the lead-in section of each electrode is sealed within one of the lamp shanks and the post sections of the electrodes are suspended in the arc chamber in a spaced apart relationship to maintain an arc therebetween. As explained in this patent, the electrode sections are accurately sized to control the flow of energy out of the arc chamber.

The lead-in and post sections of the electrodes have heretofore been individually formed to a desired diameter and then coaxially joined by means of a welding process. Because of the small size of the electrode sections, the welding process is difficult to perform and the weld tends to disrupt the geometry of the electrode in the weld zone and thus adversely effects the ability to control flow of heat out of the arc chamber.

Attempts to mechanically shape or form electrodes used in miniature and subminiature lamps to different diameters have been less than satisfactory simply because the extremely small size sections do not readily lend themselves to mechanical working.

In U.S. Pat. No. 4,452,677 there is disclosed an electromechanical process for etching a tungsten electrode to improve the electrode's ability to form an air tight seal with the shank of a quartz envelope. An electrode having a uniform cross sectional area along its entire length is completely immersed in an aqueous solution of $NaNO_2$ and a current then applied to the electrodes for a short period of time to etch the flow lines created by the fabrication process. This, in turn, establishes roughened sites along the outer surface of the electrode which enhances its ability to form a positive seal with the shank of the glass envelope.

SUMMARY OF THE INVENTION

It is a primary object of the present invention to improve arc lamps, and in particular, miniature and subminiature lamps operating at or below 40 watts.

It is a further object of the present invention to improve the electrodes used in miniature and subminiature lamps.

It is another object of the present invention to manufacture multi-tiered electrodes for use in miniature and subminiature arc lamps that will conduct heat out of the arc chamber of the lamp at a predictable rate.

A still further object of the present invention is to provide an electrode for use in a miniature or subminiature arc lamp that can be manufactured to extremely close tolerance.

These and other objects of the present invention are attained by means of an electrode highly suitable for use in miniature and subminiature arc lamps and, in particular, with arc lamps operating at or below 40 watts. The electrode is formed from a tungsten wire that has an outside diameter equal to the desired post diameter of the electrode. A section of the wire is electrochemically etched to a smaller diameter. The etching process provides for a smooth, uniform transition region between the post and lead-in sections whereby heat energy generated in the arc chamber of the envelope during lamp operation is drawn out of the arc chamber at a controlled and predictable rate by the electrode.

BRIEF DESCRIPTION OF THE DRAWINGS

For a better understanding of these and other objects of the present invention, reference shall be made to the following detailed description of the invention which is to be read in association with the following drawings, wherein.

DESCRIPTION OF THE INVENTION

Figure 1:
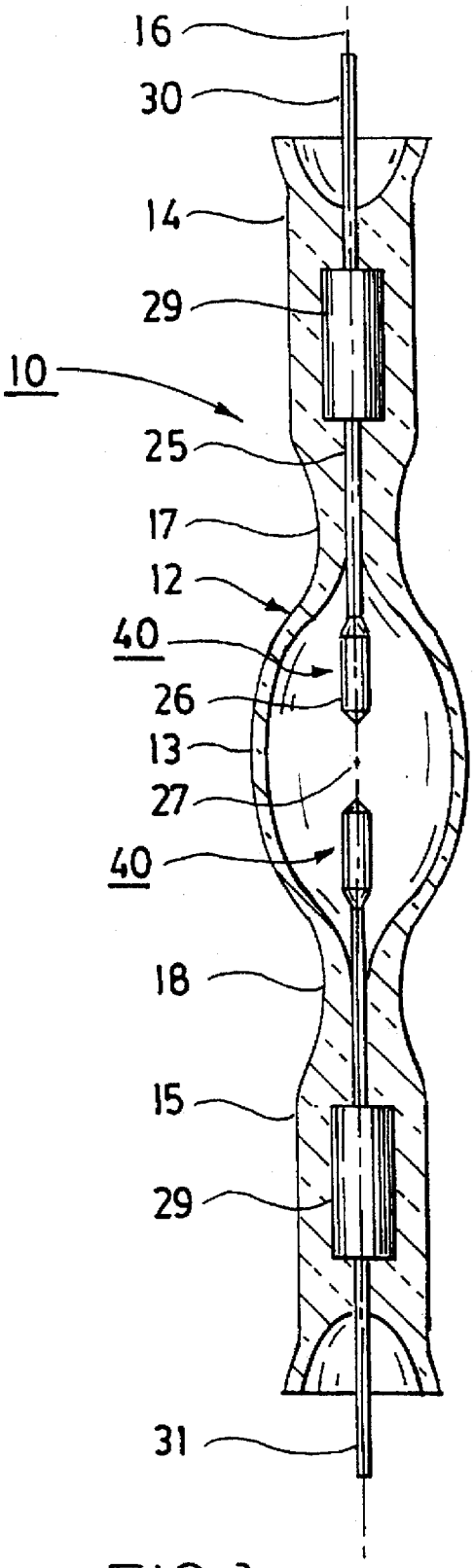
FIG. 1 is a side elevation in section of an arc lamp having a pair of opposed electrodes embodying the teachings of the present invention.

Turning initially to FIG. 1, there is shown an enlarged side elevation in section of a subminiature metal halide arc lamp, generally referenced 10, embodying the teachings of the present invention. The lamp is specifically designed to operate at or below 40 watts and includes a fused quartz envelope 12 having an elliptical shaped hollow arc chamber 13 and two opposed outwardly disposed elongated shanks 14 and 15 that are coaxially aligned along the major axis 16 of the arc chamber. Each shank contains a narrowed down neck section, 17 and 18, respectively, in the region where the shank joins the arc chamber. As explained in the above noted U.S. Pat. No. 5,144,201, the reduced diameter neck sections act as heat valves to restrict the flow of heat out of the arc chamber and thus insure that the lamp fill gases remain properly ionized when the lamp is in operation.

Figure 2:
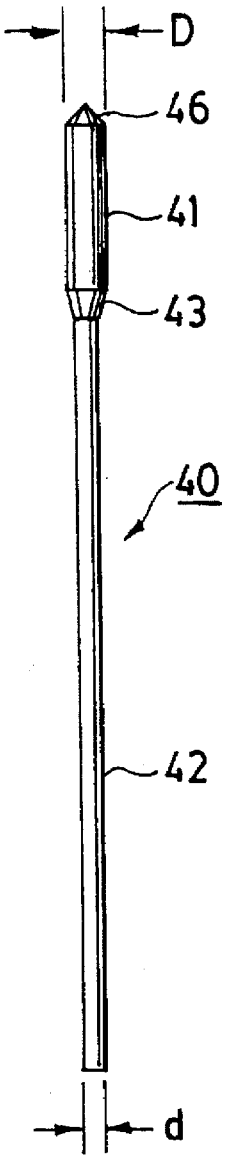
FIG. 2 is an enlarged side elevation of an electrode employed in the arc lamp of FIG. 1.

A pair of electrodes designed 40 in FIGS. 1 and 2 are mounted within the quartz envelope and although not shown, are connected to an appropriate source of power so that an arc is sustained between the electrode tips when the lamp is in operation. Each electrode includes a large diameter post section 41 suspended in the arc chamber 13 and a smaller diameter lead-in section 42 that is sealed within one of the opposing shanks. The electrodes are formed of a refractory metal, preferably tungsten, and are connected electrically to a power source so that one acts as an anode and the other as a cathode in the arc circuit.

The post section of each electrode is provided with a shaped tip 46 (FIG. 2) at its distal end that is contoured to enhance the arc geometry. The electrodes are shown in FIG. 1 equipped with conical shaped tips, however, the tip contour can change depending upon a number of variable and other lamp related factors. The lead-in ends of the electrodes are connected to electrical wires 30 and 31 by means of molybdenum foils 29—29.

The tips of the electrodes are separated in assembly to provide a predetermined arc gap 27 therebetween. The tips of the electrodes are specifically shaped to minimize lateral shifting or movement of the arc and to insure good thermal diffusion from the tip end inwardly into the post section. The mass of the post section of each electrode is relatively greater than that of the lead-in section and the sections are sized to control the flow of heat out of the arc chamber. By controlling the loss of heat along the electrodes in conjunction with the heat loss through the lamp shanks, the temperature within the arc chamber can be closely regulated to maintain the lamp performance at an optimum level.

FIG. 2 illustrates an electrode 40 embodying the teachings of the present invention that is ideally suited for use in miniature and subminiature lamps. The electrode is formed from a single segment of tungsten wire having an outer diameter equal to the desired outer diameter (D) of the post section of the electrode. The wire can be drawn or otherwise formed to extremely close tolerances using techniques well known in the art. As will be explained in greater detail below, the smaller diameter (d) lead-in section 42 and the transition section 43 of the electrode are both formed from the wire segment using an electrochemical etching process. It has been found that by use of the electrochemical etching process, the lead-in section of the electrode can also be formed to extremely close tolerances. In addition, the transition section between the post and lead-in sections of the electrode can be shaped to a smooth tapered geometry that will transfer energy from the post section to lead-in section at a predictable uniform rate. Here again, the transition region of the electrode acts as a control valve that regulates the flow of energy out of the arc chamber.

Figure 3:
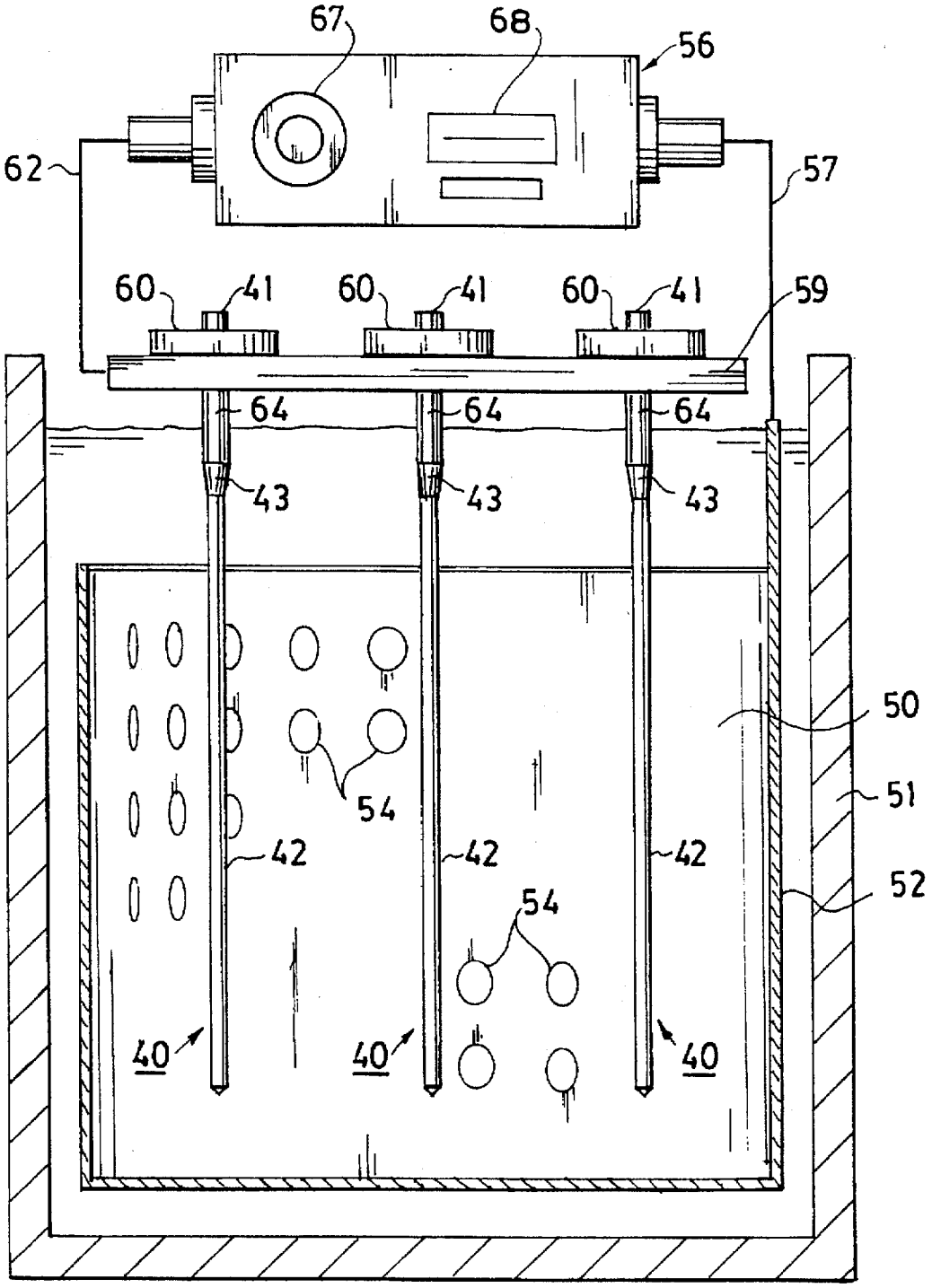
FIG. 3 is a side elevation of an electrochemical etching bath used to fabricate the electrode shown in FIG. 2.

An electrochemical process for producing close tolerance electrodes suitable for use in miniature and subminiature lamps is illustrated in FIG. 3. A quantity of caustic solution 50 is stored within an open top container 51. The bath solution preferably is a 20% by volume solution of NaoH which is well suited for electrochemically etching a tungsten wire. A basket 52 having a series of holes 54—54 formed therein is immersed below the surface of the bath. The basket is formed of a conductive material and, as will be explained below, serves as a terminal in the electro chemical etching circuit. A holding fixture 59 which is also formed of a conductive material, is supported above the level of the bath. The holding fixture is arranged to support a series of tungsten wire electrode segments 40—40 in spaced apart collets 60 or the like so that the lead-in end of each segment is disposed downwardly into the bath solution. The upper portion of each segment which forms the lower portion of the electrode post section is covered with a suitable masking material 64 to protect this portion of the electrode from the bath solution. A plurality of electrodes are placed in the holding fixture and the exposed lead-in section 42 and the transition section 43 of each electrode are immersed within the solution.

A power supply 56 is connected to both terminals of the electrochemical etching circuit and is arranged to pass a regulated current through the bath via wires 57 and 62. The power supply includes an adjustable timer 67 and a variable output control 68 which can be adjusted to regulate the rate at which material is removed from the exposed surfaces of the electrodes contained in the bath. Tests have shown that by employing the electrochemical etching process, a small diameter tungsten wire can be shaped to extremely close dimensions to provide a shaped electrode as shown in FIG. 2 for use in miniature and subminiature lamps.

Additionally, it has been found that a smooth, uniformly tapered transition region can be established between the post and lead-in sections of the electrode by again controlling the rate and time of etching. The lead-in and transition section of the electrode thus take the shape of a "pin fin" of finite length so that the heat flow rate out of the arc chamber through the electrode to be reasonably approximated or calculated. See F. Kreith, "Principles of Heat Transfer", pp. 45–48 (1958). Because each electrode can be very accurately sized to desired dimensions, the electrodes will provide predictable high performance over their lifetime.

Tests conducted on arc lamps constructed in accordance with the teachings found in U.S. Pat. No. 5,144,201, utilizing electrochemically etched electrodes fabricated as herein described, clearly illustrate that the flow of heat out of the arc chamber through the electrodes can be closely regulated in miniature and subminiature lamps to optimize lamp performance. In the case of lamps operating below 40 watts, it has been found that optimum performance can be obtained when the post section diameter of the electrode is held within a range of between 0.003 and 0.030 inches, the lead-in section diameter within a range of between 0.0015 and 0.015 inches, and the axial length of the transition section in a range of between 0.001 and 0.025 inches. More specifically, a subminiature lamp operating at about 20 watts will deliver optimum performance when utilizing electrodes having a post section diameter within a range of between 0.010 and 0.016 inches, a lead-in section diameter within a range of between 0.006 and 0.008 inches, and the axial length of the transition section in a range of about between 0.002 and 0.015 inches. Subminiature lamps operating at about 2.5 watts will deliver high efficacy when employing electrodes having a post section diameter within a range of 0.003 and 0.004 inches, a lead-in section diameter in a range of between 0.0015 and 0.002 inches and a transition section length of between 0.001 and 0.002 inches.

While this invention has been explained with reference to the structure disclosed herein, it is not confined to the details set forth and this invention is intended to cover any modifications and changes as may come within the scope of the following claims:

What is claimed is:

1. A method of forming a tungsten electrode which includes a post section of a first diameter and a lead-in section of a second smaller diameter, and a smooth, uniformly tapered transition section connecting the lead-in section and the post section, said method comprising:

(a) providing a single segment of tungsten wire;

(b) selectively masking one end of said segment of tungsten wire with a suitable masking material to protect the masked area from an electro-chemical etching solution; and (c) immersing said masked segment of tungsten wire into an electro-chemical etching solution and selectively etching said wire in the unmasked area to form an electrode having a first diameter in the masked unetched areas which constitutes a post section, and a lead-in section of a smaller diameter which has been selectively etched to the desire diameter, and an etched smooth uniformly tapered transition section between said post and lead-in sections.

* * * * *